US007640928B2

(12) United States Patent
Gregg et al.

(10) Patent No.: US 7,640,928 B2
(45) Date of Patent: Jan. 5, 2010

(54) CUTTING MACHINE FOR CUTTING FIBER-CEMENT MATERIALS AND METHOD OPERATION AND USE

(75) Inventors: Ian Gregg, Poulsbo, WA (US); Pearse W. Cashman, Indianola, WA (US)

(73) Assignee: PacTool International Ltd, Kingston, WA (US)

( * ) Notice: Subject to any disclaimer, the term of this patent is extended or adjusted under 35 U.S.C. 154(b) by 333 days.

(21) Appl. No.: 11/371,452

(22) Filed: Mar. 8, 2006

(65) Prior Publication Data

US 2007/0209489 A1 Sep. 13, 2007

(51) Int. Cl.
*B28D 1/32* (2006.01)

(52) U.S. Cl. ..... 125/23.01; 83/35

(58) Field of Classification Search ..... 125/23.01, 125/40; 83/237, 679, 694, 696, 35, 36
See application file for complete search history.

(56) References Cited

U.S. PATENT DOCUMENTS 3,958,480 A * 5/1976 Rohde et al. ..... 83/237
5,570,678 A * 11/1996 Waggoner et al. ..... 125/23.01
5,722,386 A 3/1998 Fladgard et al. ..... 125/23.01
6,102,026 A 8/2000 Fladgard et al. ..... 125/23.01
6,401,707 B1 6/2002 Fladgard et al. ..... 125/23.01
6,526,717 B2 3/2003 Waggoner et al. ..... 52/554

OTHER PUBLICATIONS

International Search Report for Application No. PCT/US07/63592; Applicant: Shear Technologies, Inc.; Date of Filing: Mar. 8, 2007; Date of Mailing: Aug. 25, 2008 (5 pages).

* cited by examiner

*Primary Examiner*—Maurina Rachuba
(74) *Attorney, Agent, or Firm*—Perkins Coie LLP

(57) ABSTRACT

A method of cutting a sheet of fiber-cement and cutting machine programmed to effect such a method is disclosed. The method includes aligning a cutting plane of the sheet with at least one blade of a first cutting station. The sheet is cut along the cutting plane to sever a strip from the sheet. A plank is formed either by the act of severing the strip from the sheet or by advancing the sheet along the path to align another cutting plane of the sheet and cutting the sheet along the cutting plane with the at least one cutting blade. The plank so formed is advanced along a path to a second cutting station.

14 Claims, 11 Drawing Sheets

CUTTING MACHINE FOR CUTTING FIBER-CEMENT MATERIALS AND METHOD OPERATION AND USE

TECHNICAL FIELD

This invention generally relates to cutting machines and methods for cutting materials, such as fiber-cement, to form fiber-cement siding used on or in houses and other structures.

BACKGROUND OF THE INVENTION

The exterior surfaces of houses and other structures are often protected by exterior siding products made from wood, vinyl, aluminum, bricks, stucco, fiber-cement and other materials. Wood and fiber-cement siding (FCS) products, for example, are generally planks, panels or shakes that are "hung" on plywood or composite walls. Although wood siding products are popular, wood siding can become unsightly or even defective because it may rot, warp or crack. Additionally, wood siding products are also highly flammable and subject to insect damage. FCS is an excellent building material because it is nonflammable, weatherproof, and relatively inexpensive to manufacture. Moreover, FCS does not rot and insects do not consume the fiber-cement composites.

FIG. 1 shows a prior art fiber-cement shake panel 20 having a length L extending along a longitudinal dimension, and a width extending along a transverse dimension that varies along the length L from a width $W_1$ to a width $W_2$. The shake panel 20 has side edges 23 separated from each other by the length L, a top edge 22 extending along the longitudinal dimension between the upper ends of the side edges 23, and a bottom edge 24 extending along the longitudinal dimension between the bottom ends of the side edges 23. The top and bottom edges 22 and 24 are typically substantially parallel to each other and separated by a widthwise dimension ($W_1$ and $W_2$) of the shake panel 20. The shake panel 20 also includes a web portion 32 and a plurality of shake sections 30*a* and 30*b* of different lengths $L_{S1}$, and $L_{S2}$ projecting from the web portion 32 and separated by slots 28. The shake sections 30*a* and 30*b*, accordingly, have widths $W_S$ corresponding to the distance between slots 28. It is particularly important that the lower edge 24 be a rough, cut edge to give the appearance that the fiber-cement shake panel 20 is formed of wood and cut with a saw.

A prior art cutting machine 34 suitable for forming the shake panel 20 is shown in FIG. 2. The cutting machine 34 includes a frame 36, a plurality of cutting stations 35*a*-35*d*, and a plurality of rollers 58 for supporting and advancing a sheet of fiber-cement to be cut. The first cutting station 35*a* includes a plurality of actuators 38 attached to the frame 36 and a driver 40 projecting from each of the actuators 38. The first cutting station 35*a* further includes a platform 44 slidably attached to the frame 36 and a fixed platform 52 attached to the frame 36. The actuators 38 are operable to extend and retract the drivers 40 in order to move the platform 44 upwardly and downwardly in the direction A. The first cutting station 35*a* also includes a upper blade assembly 42 and a lower blade assembly 50. The upper blade assembly 42 includes a first blade holder 46 attached to the movable platform 44 and a first blade 48 attached to the first blade holder 46. The lower blade assembly 50 includes a second blade holder 54 attached to the fixed platform 52. A second blade 56 is attached to the second blade holder 54. The first and second blades 48 and 56 are aligned with each other and, respectively, extend along a length sufficient to singulate a plank from the larger sheet of fiber-cement. The first cutting station 35*a* is used to cut a plurality of planks from a larger sheet of fiber-cement and will be discussed in more detail below.

The second cutting station 35*b* includes a slot cutting assembly 53 including a blade holder 54 having a plurality of slot cutting blades 56 attached thereto. Each of the slot cutting blades 56 is configured to cut the slots 28 shown in the shake panel 20 of FIG. 1. The blade holder 54 is pivotally connected to the frame 36 and may be rotated between a cutting position and a retracted position in the direction R by extension and retraction of an actuator 58 coupled to the blade holder 54.

The third cutting station 35*c* includes a cutting assembly 63 very similar to the cutting assembly 53 of the second cutting station 35*b*. The third cutting station 35*c* also includes a blade holder 62 pivotally connected to the frame 36 and operable to be rotated in the direction R, as shown, by extension and retraction of an actuator 60 coupled to the blade holder 62. A plurality of slot cutting blades 64 are attached to the blade holder 62 and each of the slot cutting blades 64 are configured to cut the slots 28 shown in the shake panel 20 of FIG. 1. However, as will be discussed in more detail below, in operation, the cutting assembly 63 is used to cut the slots 28 in every plank cut from the sheet of fiber-cement except for the slots 28 cut in the last plank, which are cut by the second cutting assembly 35*b*.

The fourth cutting station 35*d* is a configured to cut the shake sections 30*a* of the shake panel 20 in order to vary the lengths ($L_{S1}$, and $L_{S2}$) of the shake sections as shown in FIG. 1. The cutting assembly 65 includes a plurality of actuators 74 attached to the frame 34 and a driver 76 projecting from each of the actuators 74. The fourth cutting station 35*d* further includes a movable platform 66 slidably attached to the frame 36 and a fixed platform 72 attached to the frame 36. The actuators 76 are operable to extend and retract the drivers 76 in order to move the platform 66 upwardly and downwardly in the direction A. The fourth cutting station 35*d* also includes a plurality of first blade assemblies 65 and second blade assemblies 75. Each of the first blade assemblies 65 includes a first blade holder 68 attached to the movable platform 66 and first blade 70 attached to the first blade holder 68. Each of the second blade assemblies 75 includes a second blade holder 74 attached to the fixed platform 72 and a second blade 76 is attached to the second blade holder 74. The first and second blade assemblies 65 and 75 are staggered and arranged in transversely spaced apart pairs with their respective first and second blades 70 and 76 aligned with each other. Accordingly, the fourth cutting station 35*d* may cut the shake sections 30*a* of the shake panel 20 to vary the length.

With reference to FIGS. 2 and 3, in operation, a fiber-cement sheet 80 is provided and advanced along a path $P_1$ to the first cutting station 35*a*. The sheet 80 includes first and second edges 82 and 84 each having a length equal to L, and side edges 86, all of which are very smooth because they were cut using a process such as water jet cutting. The sheet 80 may be cut into a plurality of planks 90*a*-90*e*. Although five planks 90-90*e* are shown in FIG. 3, the sheet 80 may be cut into a different number of planks depending on the size of the sheet 80 and the planks to be cut therefrom. At the first cutting station 35*a*, the sheet 80 is cut into a first plank 90*a* along a cutting plane $C_1$ and is advanced to the third cutting station 35*c*. At the third cutting station 35*c*, the slots 28 are formed in the first plank 90*a* and the shake panel 20*a* is formed. Simultaneously, with advancing the first plank 90*a* to the third cutting station 35*c*, the sheet 80 is advanced along the path $P_1$ to align cutting plane $C_2$ thereof with the first and second blades 48 and 54 of the first cutting station 35*a*. A second plank 90*b* is cut from the sheet 80 along a cutting plane $C_2$ using the first cutting station 35*a*. The second plank 90*b* is advanced along the path $P_1$ to the third cutting station 35*c* where the slots 28 are cut in second plank 90*b* to form the shake panel 20*b* and the shake sections 30*a* thereof. If desired, as the slots 28 are being formed in the plank 90*b*, the shake panel 20*a* may be advanced in the direction $P_1$ to the fourth cutting station 35*d* where the length of the shake sections 30*a* thereof may be trimmed.

This process is continuously repeated until the fifth/last plank 90*e* is ready to have the slots 28 formed therein. The upstream edge 84 of the fifth plank 90*e* has a factory edge that was cut using a technique such as water jet cutting, which produces a very smooth edge. However, consumers would like the edge 24 of the shake panel 20*e* to have a rough cut edge giving the appearance of a wood product cut with a saw. Thus, the fifth plank 90*e* is advanced to the second cutting station 35*b* along the path $P_1$ and the slot cutting assembly 53 cuts the slots 28 in the fifth plank 90*e* that extend widthwise inwardly toward the factory edge 84. In order to advance the formed shake panel 20*e*, the rollers 58 are stopped and then the shake panel 20*e* is moved in an opposite direction along the path $P_2$. Then, the slot cutting assembly 35*b* is pivoted to its retracted position.

The process of forming the slots 28 in the last plank 90*e* using the second cutting station 35*b* reduces the speed at which shake panels 20*a*-20*e* may be cut from the sheet 80 because the shake panel 20*e* is stopped and then moved in reverse in the direction along the path $P_2$ in order to retract the cutting assembly 53. Additionally, the shake sections 30*a* of the last shake panel 20*e* cannot be trimmed using the fourth cutting station 35*d* due to the orientation of the shake sections relative to the blade assemblies 65 and 75 thereof. Furthermore, if each of the shake sections have a uniform length, the operator manually rotates the last shake panel 20*e* in order to stack it with the slots 28 oriented in the same direction of the shake panels 20*a*-20*d*. If the shake sections have different lengths ($L_{S1}$, and $L_{S2}$), the operator stacks the shake panels 20*a*-20*d* in one pile and stacks the shake panels 20*e* having shake sections 30 of uniform length in another pile.

Accordingly, there is still a need in the art for a more efficient cutting machine and method suitable for forming shake panels in which the bottom edge of the shake sections have a rough, cut surface finish. It would also be desirable that in such a cutting machine and method that the operator does not have to laboriously manually rotate the shake panels in order to stack them all in the same orientation. Moreover, it would be desirable that the cutting machine and method can cut shake panels, from a given a sheet, that all have the same shake section configuration.

SUMMARY OF THE INVENTION

The invention is directed to cutting machines and methods for cutting materials, such as fiber-cement. In one aspect of the invention, a method of cutting a sheet of fiber-cement and cutting machine programmed to effect such a method is disclosed. The method includes aligning a cutting plane of the sheet with at least one blade of a first cutting station. The sheet is cut along the cutting plane to sever a strip therefrom. A plank is formed either by the act of severing the strip from the sheet or by advancing the sheet to align another cutting plane of the sheet and cutting the sheet along the cutting plane with the at least one cutting blade. The plank so formed is advanced along a path to a second cutting station.

Another aspect of the invention is directed to a cutting machine. The cutting machine includes a plank cutting assembly having a single upper cutting blade having a first cutting edge, and a single lower cutting blade having a second cutting edge that opposes the first cutting edge. The lower cutting blade is held in a lower blade holder including first and second portions with the second cutting blade positioned therebetween. The cutting machine includes at least one actuator operable to move a driver between a release position and a cutting position along a stroke path. One of the upper and lower cutting blades is operably coupled to the driver to move along the stroke path. The second portion of the lower blade holder also includes a downwardly slanted surface positioned on one side of the stroke path so that a strip cut from a workpiece positioned between the upper and lower blades can travel downwardly below the lower blade holder. The cutting machine also includes a conveyor assembly configured to support and operable to move a workpiece along a path to and from the plank cutting assembly.

Yet another aspect of the invention is directed to a method of severing a strip from a sheet of fiber-cement. The method includes supporting a portion of the sheet having a length and a width, and driving a first cutting blade against one side of the sheet when the sheet is supported. The method further includes severing a strip from an unsupported portion of the sheet, the strip having a length equal to the length of the sheet.

DETAILED DESCRIPTION OF THE EMBODIMENTS

Figure 1:
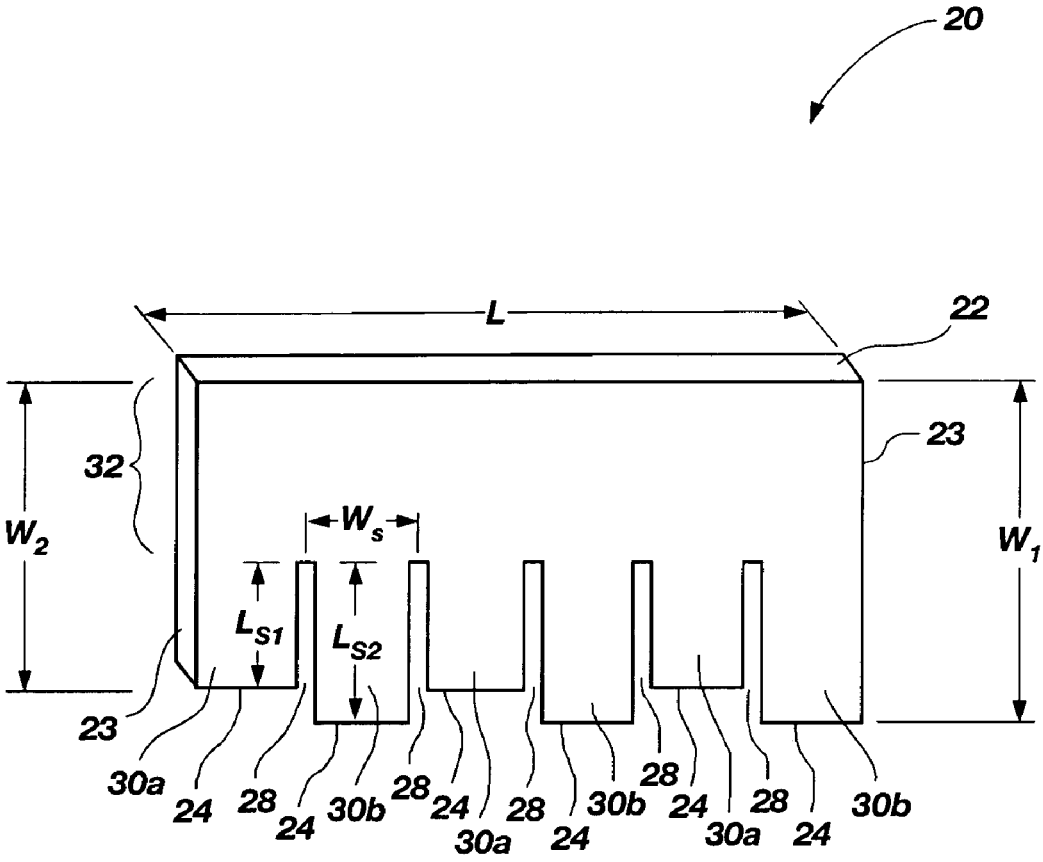
FIG. 1 (PRIOR ART)
FIG. 1 is an isometric view of a prior art fiber-cement shake panel.
Figure 2:
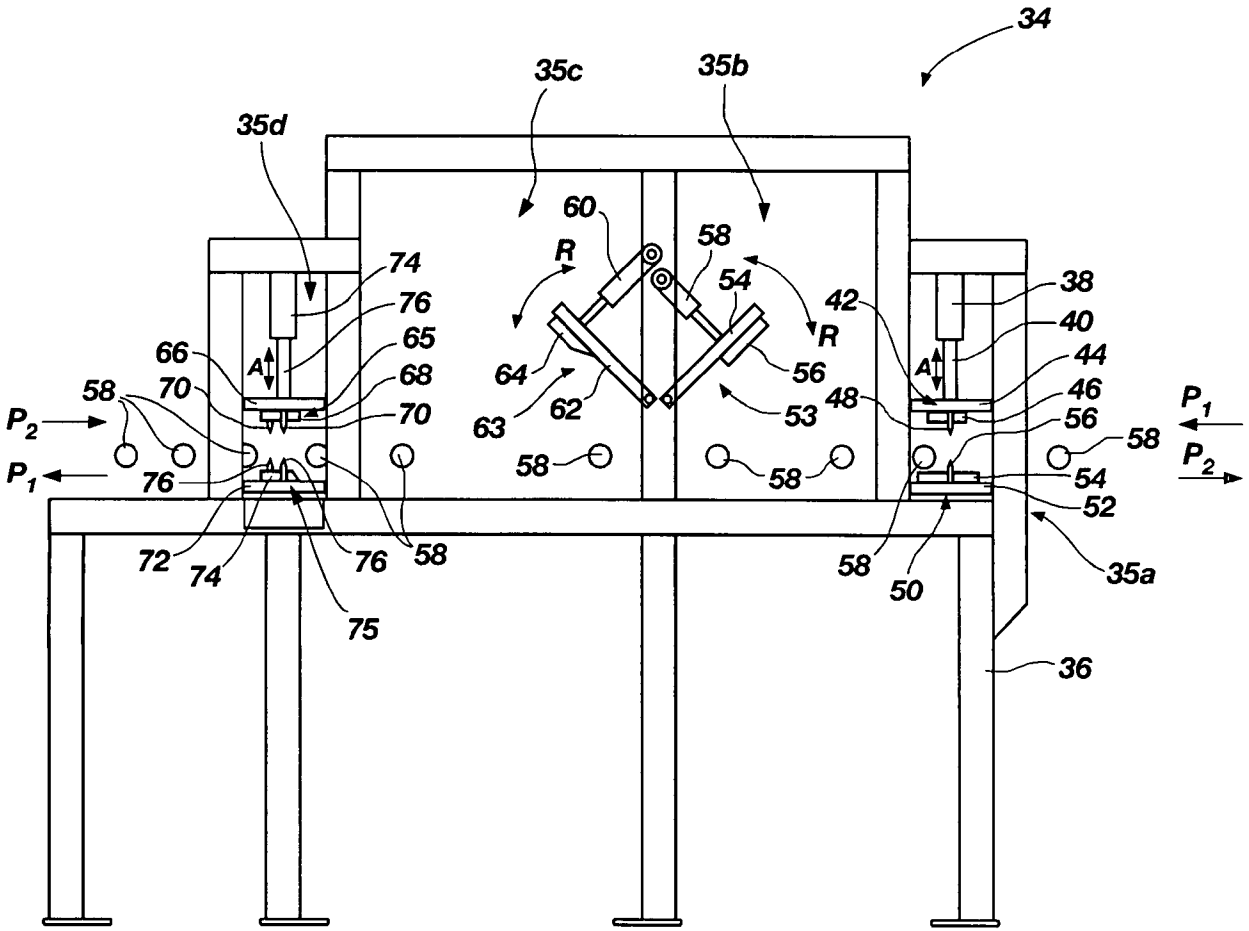
FIG. 2 (PRIOR ART)
FIG. 2 is a side view of a prior art cutting machine operable to cut the shake panel of FIG. 1.
Figure 3:
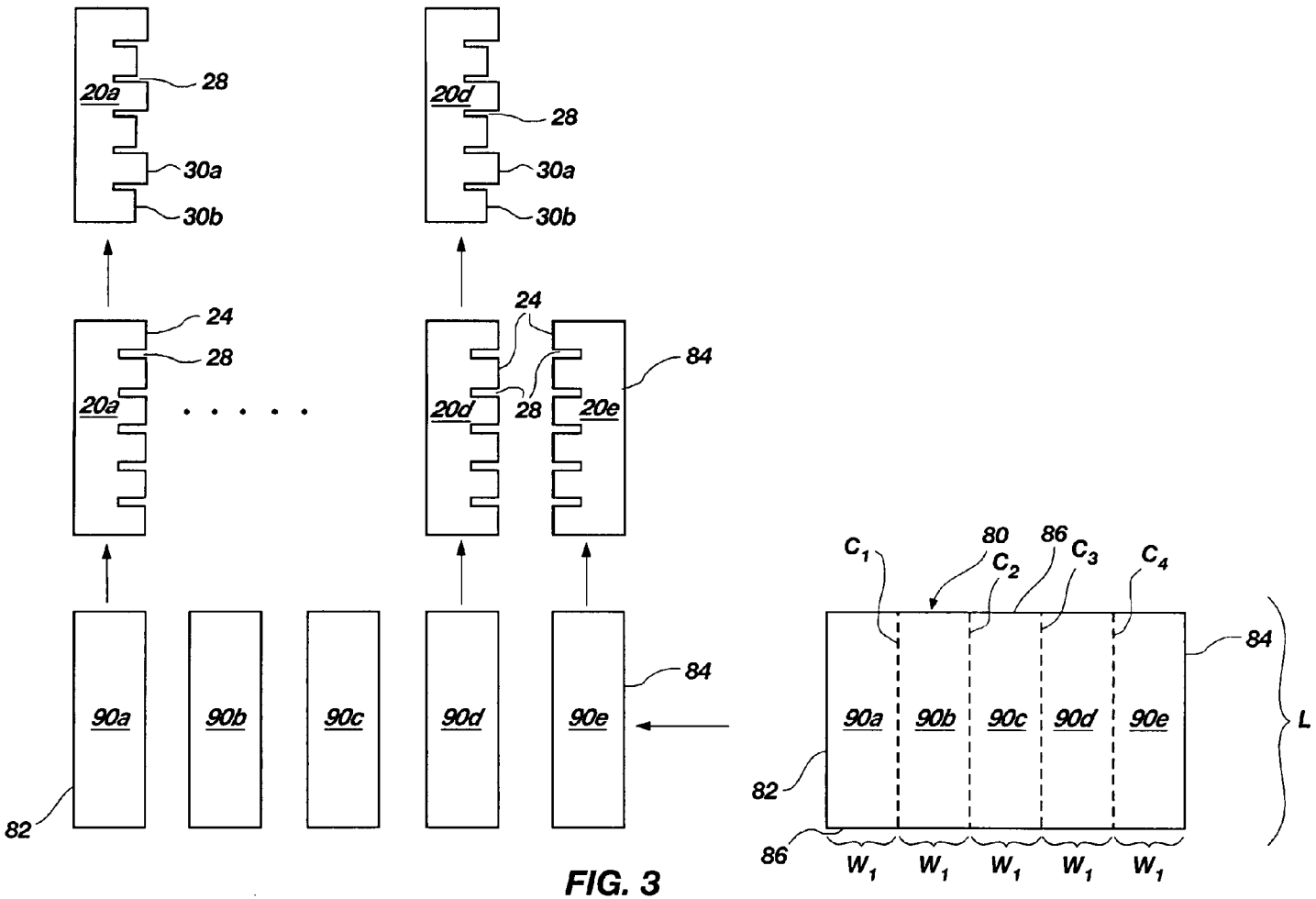
FIG. 3 (PRIOR ART)
FIG. 3 is a schematic diagram of a prior art method of manufacturing the shake panel of FIG. 1.

The invention is directed to cutting machines and methods for cutting fiber-cement materials to form structures, such as shake panels. Many specific details of certain embodiments of the invention are set forth in the following description and in FIGS. 4 through 11 in order to provide a thorough understanding of such embodiments. One skilled in the art, however, will understand that the invention may have additional embodiments, or that the invention may be practiced without several of the details described in the following description. In the figures and description that follow, like elements and features are identified by like reference numerals.

Figure 4:
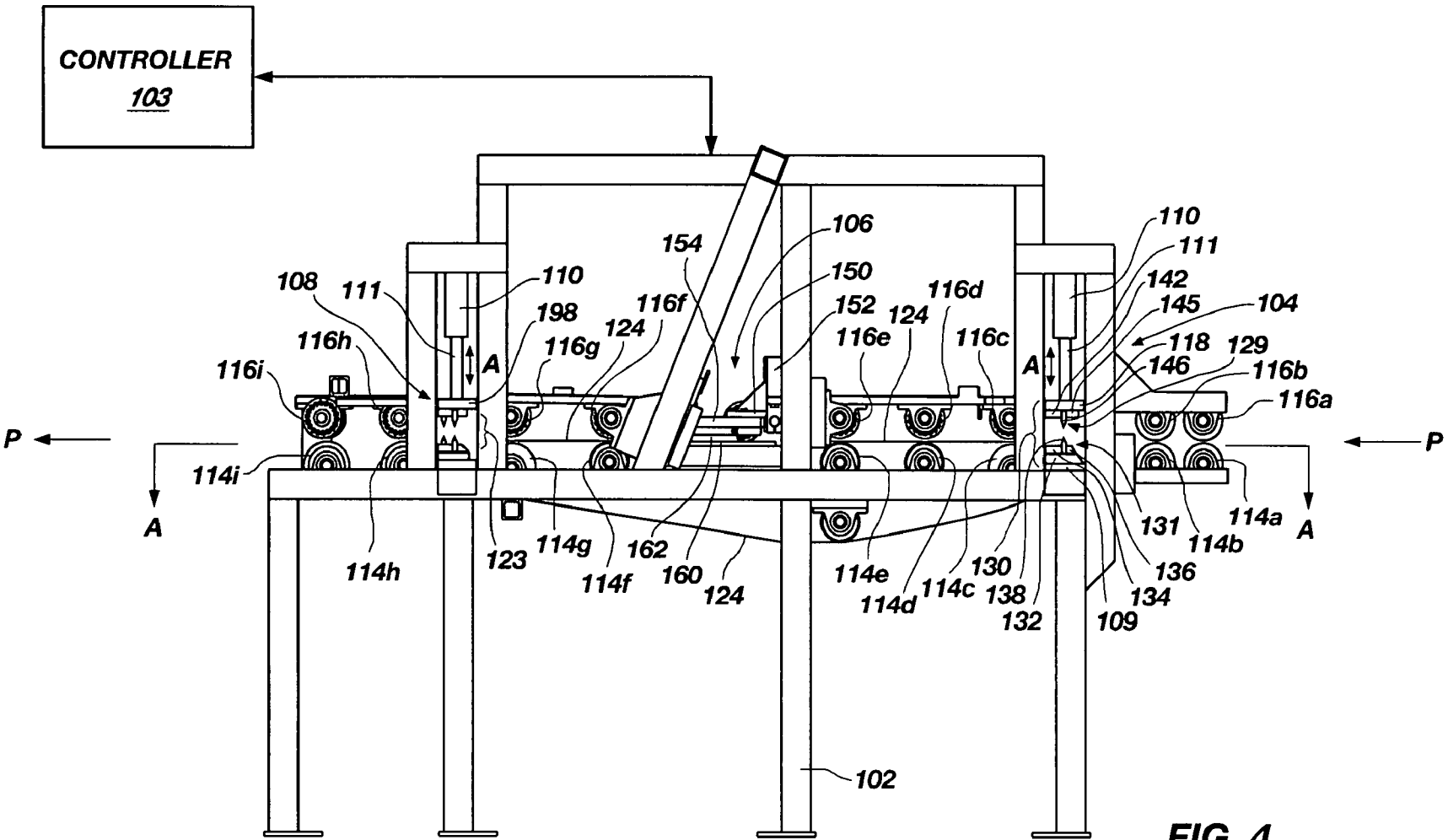
FIG. 4 is a schematic side elevation view of a cutting machine and its associated controller according to one embodiment of the invention.
Figure 5:
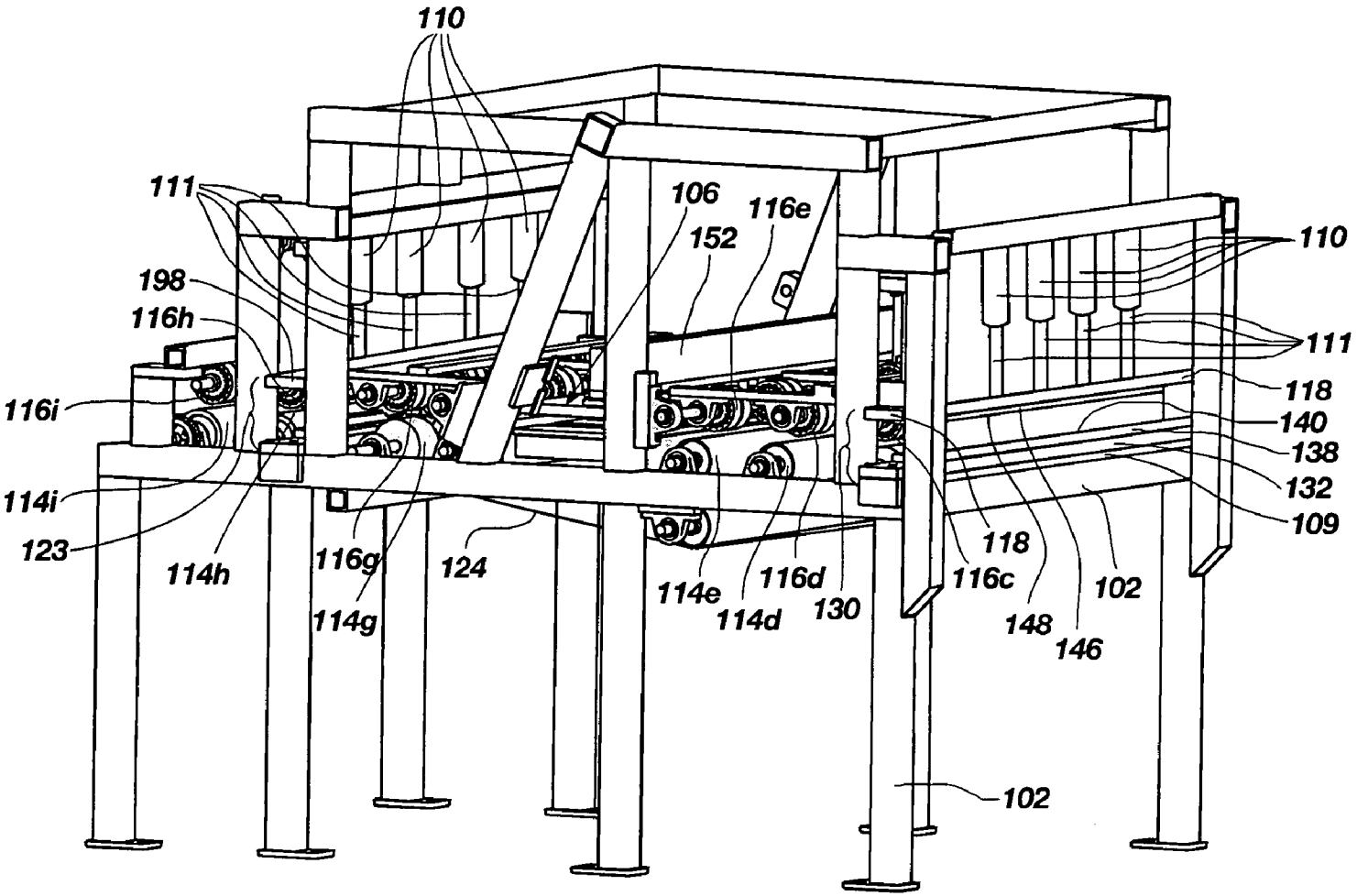
FIG. 5 is a schematic partial isometric view of a cutting machine of FIG. 4 with the upstream rollers removed to show the lower blade of the plank cutting station more clearly.

FIG. 4 is a side elevation view and FIG. 5 is an isometric view of a cutting machine 100 in accordance with one embodiment of the invention. The cutting machine 100 is suitable for cutting workpieces formed of fiber-cement having cement, silica sand, and cellulose fiber constituents to form shake panels of various geometries such as, for example, the shake panel 20 of FIG. 1. Of course, the cutting machine 100 may be configured to cut shake panel geometries different than that of the shake panel 20 shown in FIG. 1. For example, the shake sections 30 may have different lengths and the width of the shake sections 30*a* and 30*b* may be different.

The cutting machine 100 includes a frame 102 and may include three different cutting stations configured to perform different cutting operations on a sheet of material or a plank or siding piece cut therefrom. The cutting machine 100 also has a conveyor assembly, which will be discussed in more detail below, operable to move a workpiece along a path P between the three different cutting stations. The three different cutting stations include a plank cutting station 104, a slot cutting station 106, and a shake section cutting station 108. The plank cutting station 104 includes a platform 118 slidably attached to the frame 102 and a plurality of actuators 110. Each of the actuators 110 has a driver 111 projecting therefrom that is operably coupled to the platform 118. The plank cutting station 104 also includes a plank cutting assembly 130 having a upper blade assembly 129 mounted on the platform 118 and a lower blade assembly 131 mounted on the frame 102. The actuators 110 may extend and retract the drivers 111 to move the platform 118 and the upper blade assembly 129 carried by it along a stroke path A between a release position, as shown in FIGS. 4 and 5, and a cutting position to cut a plank from a larger sheet of material. In one embodiment, the actuators 110 may be electrically driven cams. In another embodiment, the actuators 110 may be pneumatic or hydraulic cylinders and the drivers 111 may be rods or shafts. In another embodiment, the drivers 111 may be ball screws that threadly engage the platform 118. In yet another embodiment, the actuators 110 may be linear actuators.

The slot cutting station 106 is positioned downstream from the plank cutting station 104 and includes a slot cutting blade assembly 150 configured to cut slots in a plank cut by the plank cutting station 104. The slot cutting blade assembly 150 may be pivotally mounted to the frame 102 so that it may be rotated between a retracted position and, as shown in FIGS. 4 and 5, a downward cutting position. The slot cutting assembly 150 includes a blade holder 154 that carries a plurality of cutting blades 162 and a die 160 with corresponding slots therein (not shown in FIGS. 4 and 5).

The shake section cutting station 108 may be positioned downstream from the slot cutting station 106. The shake section cutting station 108 includes a platform 198 slidably attached to the frame 102 and a plurality of actuators 110. Each of the actuators 110 has a driver 111 projecting therefrom that is operably coupled to the platform 198. The shake section cutting station 108 also includes a plurality of shake cutting assemblies 123. The shake cutting assemblies 123 are configured to trim the length of the shake sections of a siding panel. As with the plank cutting station 104, the actuators 110 may extend and retract the drivers 111 to move the platform 198 and the cutting assemblies carried by it along a stroke path A between a release position, as shown in FIGS. 4 and 5, and a cutting position to cut shake sections in a shake panel.

The cutting machine 100 also includes a controller 103 containing a program instructions stored in memory that may be used to control the operation of the various components of the cutting machine 100 such as, the cutting stations 104, 106, and 108 and the conveyor assembly. The controller 103 may be configured to enable the operator to change the program of instructions, perform diagnostics, fine tune the cutting machine 100's operation, among other functions.

Figure 6:
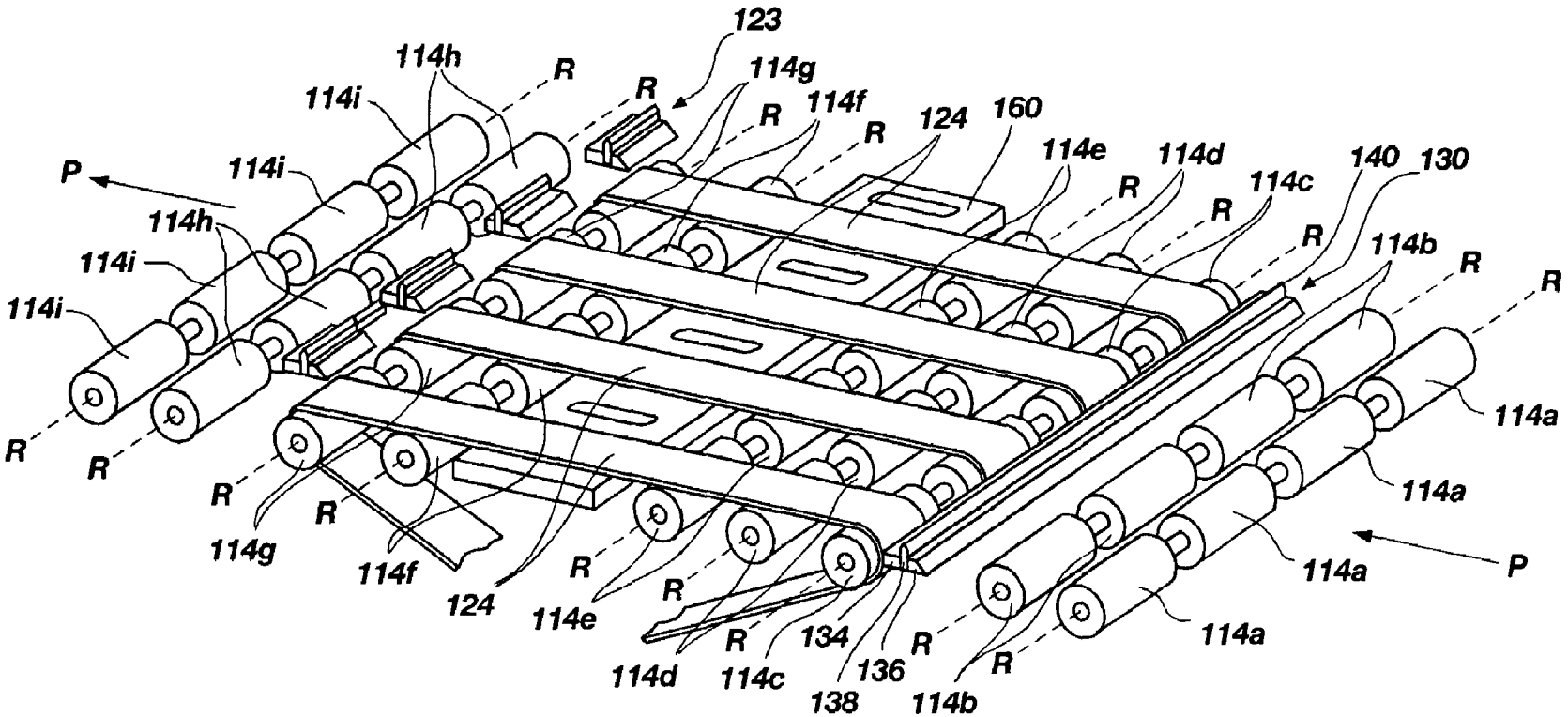
FIG. 6 is a schematic isometric view of taken along A-A of FIG. 4 illustrating the positions of the lower rollers, lower blade assembly of the plank cutting station, lower blade assembly of the shake cutting station, and the die of the slot cutting station.

Referring now also to FIG. 6, as briefly discussed above, the cutting machine 100 includes a conveyor assembly operable for supporting and moving a workpiece between the plank cutting station 104, slot cutting station 106, and shake section cutting station 108. In one embodiment, the conveyor assembly includes a plurality of lower rollers 114 and a plurality of upper rollers 116 (not shown in FIG. 6), each of which rotates about a rotational axis R-R transverse to the path P. The lower rollers 114 may be grouped in sets of lower rollers 114*a*-114*i* that are spaced apart from each other along the path P and mounted to the frame 102. The upper rollers 116 may also be grouped in sets of upper rollers 116*a*-116*i* that are mounted to the frame 102 and also rotate about respective rotational axes R-R (not shown) to cooperate with the corresponding lower rollers 114*a*-114*i* for moving a workpiece along the path P. The upper rollers 116*a*-116*g* may be formed of a resilient, deformable material that will not permanently damage a workpiece formed of fiber-cement. The conveyor assembly may further includes a plurality of belts 124 extending about the lower rollers 114*c*-114*g* and spaced apart along the rotational axes R-R. As best shown in FIG. 6, the belts 124 extend over the die 160 and between slots 162 thereof of the slot cutting blade assembly 150. The conveyor assembly may also include components for selectively tensioning the belts 124 an appropriate amount.

In operation, a sheet of fiber-cement is supported on the lower rollers 114*a*-114*i* and belts 124 and disposed between the lower roller 114*a*-114*i* and the upper roller 116*a*-116*i* while it is transported along the path P by a drive system (not shown) effecting rotation of the lower rollers 114*a*-114*g*. The upper rollers 116*a*-116*i* downwardly press against the sheet to help prevent it from slipping transversely to the path P when it is moved along the path P and when it is cut at one of the cutting stations 104, 106, and 108. The position of the sheet may be detected using optical detectors (not shown) that are configured to detect when the sheet has reached a particular cutting station 104, 106, or 108.

Referring again to FIG. 4, in another embodiment, the location of the shake section cutting station 108 and the slot cutting station 106 may be reversed. Thus, in such an embodiment, the shake section cutting station 108 is positioned upstream from the slot cutting station 106 and receives a plank from the plank cutting station 104 and cut shake sections therein. The slot cutting station 108 receives the plank from the shake cutting station 108 and cuts slots therein between adjacent shake sections. In yet another embodiment, the shake section cutting station 108 may be eliminated. Of course, such an embodiment would not be as versatile as the cutting machine 100 for forming shake panels having a variety of different shake section geometries.

Figure 7:
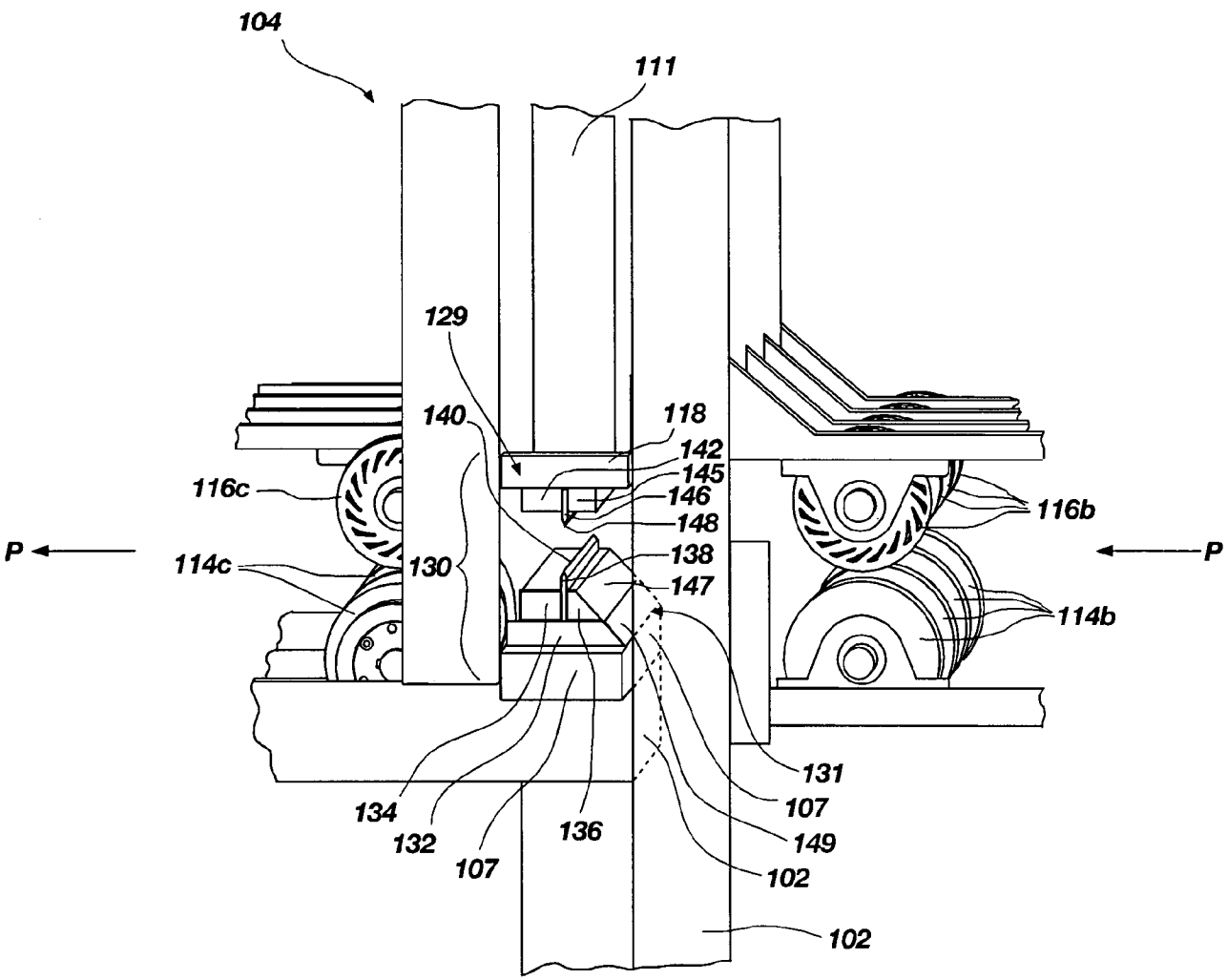
FIG. 7 is an enlarged schematic side isometric view of FIG. 4 showing the plank cutting station configured to cut planks from a sheet of fiber-cement according to one embodiment of the invention.

Referring now to FIG. 7, which shows an enlarged side isometric view of the plank cutting station 104 and the plank cutting assembly 130 according to one embodiment, and FIG. 5. As discussed above, the plank cutting assembly 130 includes the upper blade assembly 129 mounted on the platform 118 and the lower blade assembly 131. The upper blade assembly 129 includes blade holders 142 and 145 attached to the platform 118. The blade holders 142 and 145 hold an upper blade 146 having a cutting edge 148 extending transversely across the path P. The lower blade assembly 131 includes blade holder portions 134 and 136 mounted to an intermediate plate 132. The intermediate plate 132 may be mounted to a base plate 107, which may be slidably mounted over a section of the frame 102. The base plate 107 may be slid along a section of the frame 102 in a direction transverse to the path P to facilitate removal and installation of the second cutting assembly 131. The blade holder portions 134 and 136 hold a lower blade 138 having a cutting edge 140 that opposes and is generally aligned with the cutting edge 148 of the first blade 145. The lower rollers 114*b* and 114*c* are positioned laterally adjacent to the plank cutting station 104 and vertically so that a sheet may be positioned between the first and second cutting assemblies 129 and 131 and supported a selected distance above the cutting edge 140 of the lower blade 138.

In the embodiment shown in FIG. 7, the blade holder portion 136 includes a slanted surface 147 and the intermediate plate 132 also includes a slanted surface 149, both of which extend along their respective lengths. The slanted surface 149 extends so that an edge thereof may overlie an edge of the base plate 107 and a section of the frame 102 that the lower blade assembly 131 is mounted over. Thus, the slanted surface 147 and the slanted surface 149 are generally coplanar with each other and define a pathway in which strips severed from a sheet on the upstream side of the lower blade 138 of the plank cutting assembly 130 may fall downwardly on the upstream side of the lower blade 138 to the ground or to a waste disposal conveyor (not shown) situated below the plank cutting assembly 130.

With continued reference to FIG. 7, in operation, a sheet of fiber-cement is supported on the lower rollers 114, the number of rollers 114 that support the sheet being dependent upon the length of the sheet, and the upper blade 146 is driven into a first side of the sheet to bend the sheet toward the lower blade 138 until the lower blade 138 engages an opposing second side of the sheet whereby the sheet is fractured or cut along a cutting plane transverse to the path P. In another mode of operation, a strip of a sheet of fiber-cement may also be trimmed or severed from sheet on the upstream side of the lower blade 138 by positioning the sheet on the downstream rollers 114*c*-114*e* and the belts 124 extending thereover, and severing the unsupported portion of the sheet on the upstream side of the lower blade 138. This severed portion may fall downwardly on the upstream side the lower blade 138 to the ground or to a waste disposal conveyor (not shown) situated below the plank cutting assembly 130.

Figure 8:
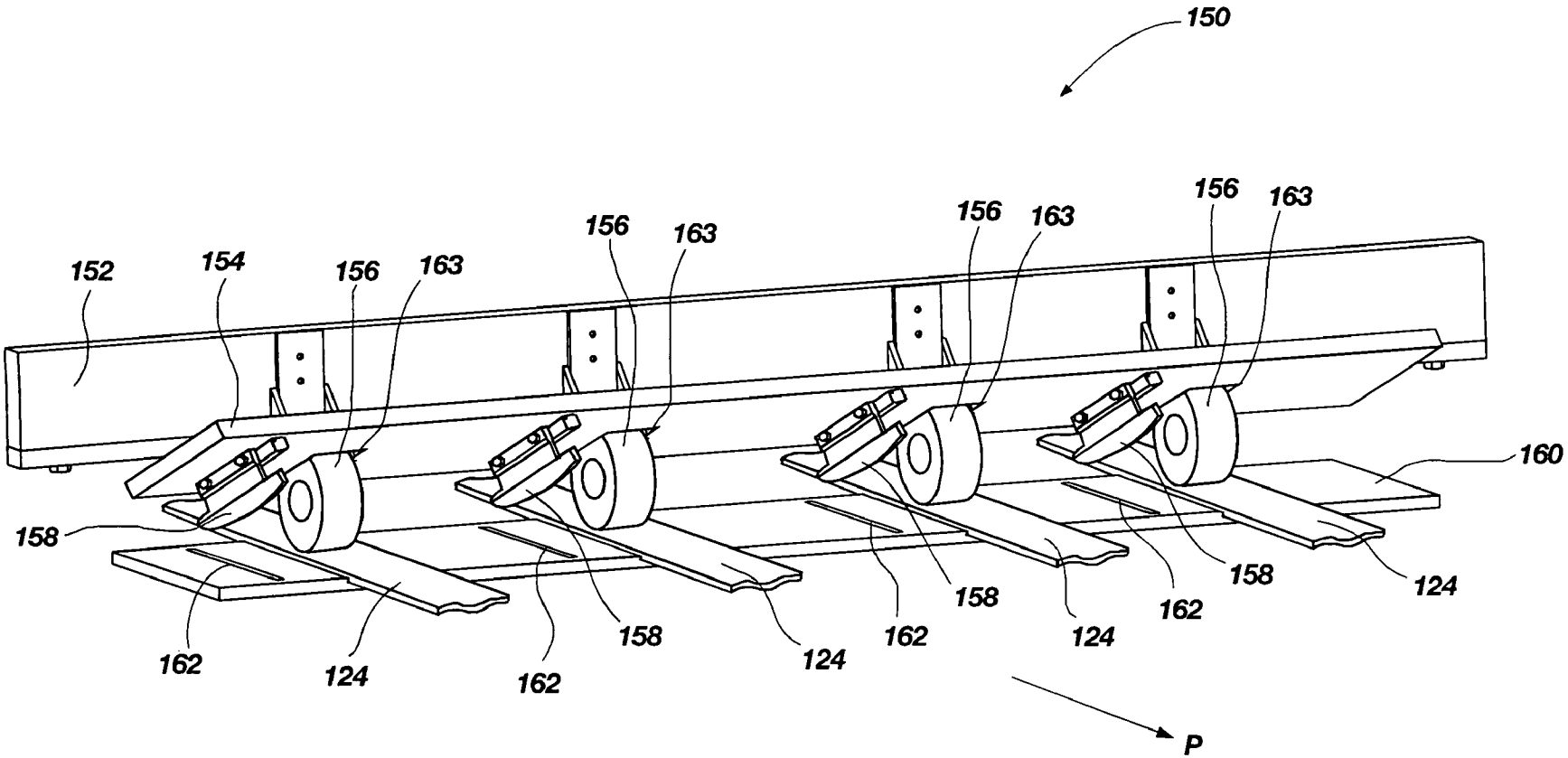
FIG. 8 is an enlarged schematic isometric view of the slot cutting assembly of the slot cutting station of FIG. 4 configured to cut slots in the plank according to one embodiment of the invention.

FIG. 8 is an enlarged isometric view of the slot cutting assembly 150 according to one embodiment. The slot cutting assembly 150 includes a support arm 152 that is attached to the frame 102 (not shown in FIG. 8). A blade holder 154 is pivotally mounted to the support arm 152 via a shaft (not shown). The blade holder 154 has a plurality of slot cutting blades 158 attached thereto, and may rotate between a retracted position and a cutting position under actuation by an actuator operably coupled to the shaft. In various embodiments, the actuator may be a hydraulic actuator, pneumatic actuator, a linear actuator, or an electrically driven cam. The slot cutting assembly 150 further includes the die 160 having the plurality of slots 162 formed therein spaced apart to correspond to the spacing of the slot cutting blades 158. Although the slot cutting blades 158 and corresponding slots 162 in the die 160 are shown evenly spaced apart to form the slots 28 shown in the shake panel 20 of FIG. 1, the slot cutting blades 158 and corresponding slots 162 may be spaced apart so that the spacing of the slots 28 ($W_S$) of the shake panel 20 may be different for some or all of the shake sections 30*a* and 30*b* of the shake panel 20. As shown in FIG. 8, the belts 124 previously shown in FIGS. 4 through 6 also extend over the die 160 and between the slots 162. Upper wheels 156 are mounted to the blade holder 154 and aligned with one of the belts 124. The upper wheels 156 may also be formed from a resilient, deformable material that presses against the top of a sheet being cut to prevent it from slipping transversely to the path P. The blade holder 154 also has a plurality of cutouts 163 formed therein so that upper wheels 156 are received by a corresponding one of the cutouts 163 and when the blade holder 154 is rotated, the upper wheels 156 do not physically interfere with the rotation of the blade holder 154.

With continued reference to FIG. 8, in operation, the plank so cut at the plank cutting station 104 is moved along the path P by the lower rollers 114 and belts 124 to the die 160 of the slot cutting assembly 150 when the blade holder 154 is in its upward retracted position. The blade holder 154 rotates downwardly so that the slot cutting blades 158 penetrate through the plank and are received into corresponding slots 162 formed in the die 160. After cutting, the blade holder 154 is pivoted upwardly to its retracted position. The shake panel 20 so cut at the slot cutting station 108 may be moved along the path P when the blade holder 154 is in its cutting position or retracted position.

Figure 9:
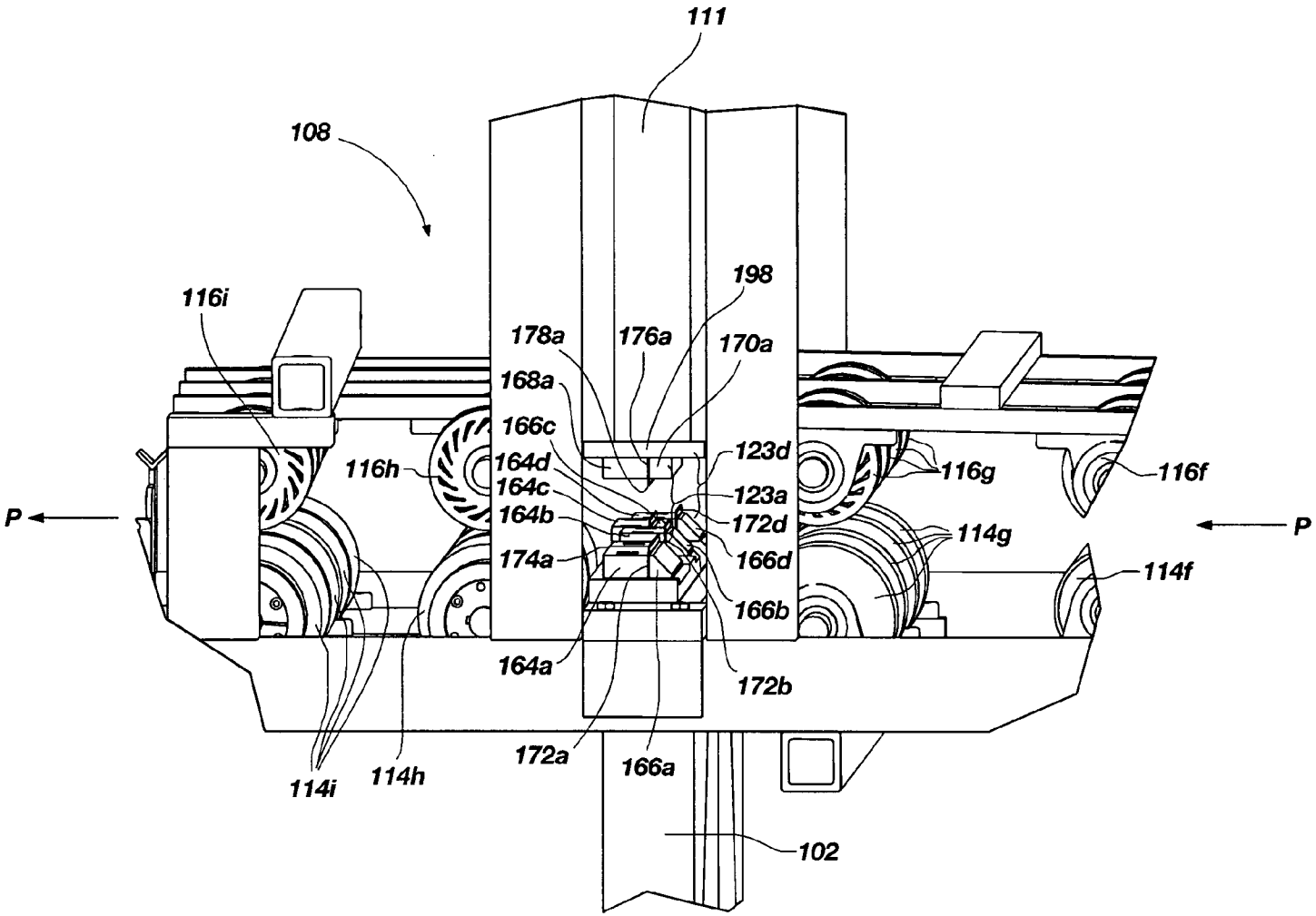
FIG. 9 is an enlarged schematic side isometric view of FIG. 4 showing the shake section cutting station configured to cut the shake sections of a shake panel to different lengths according to one embodiment of the invention.

FIG. 9 is an enlarged side isometric view of the shake section cutting station 108 and a plurality of shake cutting assemblies 123*a*-123*d* thereof according one embodiment. Each of the shake cutting assemblies 123*a*-123*d* are laterally spaced apart from each other. Each of the shake cutting assemblies 123*a*-123*d* includes a corresponding upper blade assembly mounted on the platform 198 and lower blade assembly mounted on the frame 102. The shake cutting assemblies 123*a*-123*d* also includes a corresponding lower holder portion 164*a*-164*d* and 166*a*-166*d* that hold a corresponding lower blade 172*a*-172*d* having an edge 174*a*-174*d* (although only edge 174*a* is labeled for clarity). The shake cutting assemblies 123*a*-123*d* also includes a corresponding upper holder portion 168*a*-168*d* and 170*a*-170*d* that hold a corresponding upper blade 176*a*-176*d* having a corresponding edge 178*a*-178*d*. Similar to the plank cutting assembly 130, the edges 174*a*-174*d* are aligned with and opposite a corresponding one of the edges 178*a*-178*d*. However, each of the shake cutting assemblies 123*a*-123*d* are selectively positioned along the path P to cut and define the shake sections to a selected geometry on a shake panel cut at the slot cutting station 106. Accordingly, the particular arrangement and number of the shake cutting assemblies 123*a*-123*d* may be varied depending upon the desired shake pattern and geometry. For example, the shake cutting assemblies 123*a*-123*d* shown in FIG. 8 are configured to trim the shake sections 30*a* of the shake panel 20 (FIG. 1) to the length $L_{S1}$. In addition to the configuration of the shake cutting station 108 shown in FIGS. 4, 5, and 9, the shake cutting station 108 may be adapted to cut shake sections having rounded ends, scalloped ends, or another desired configuration. One suitable cutting apparatus to enable cutting such geometries is disclosed in U.S. Pat. No. 5,722,386 to Fladgard et al., which is herein incorporated by reference.

Figure 10:
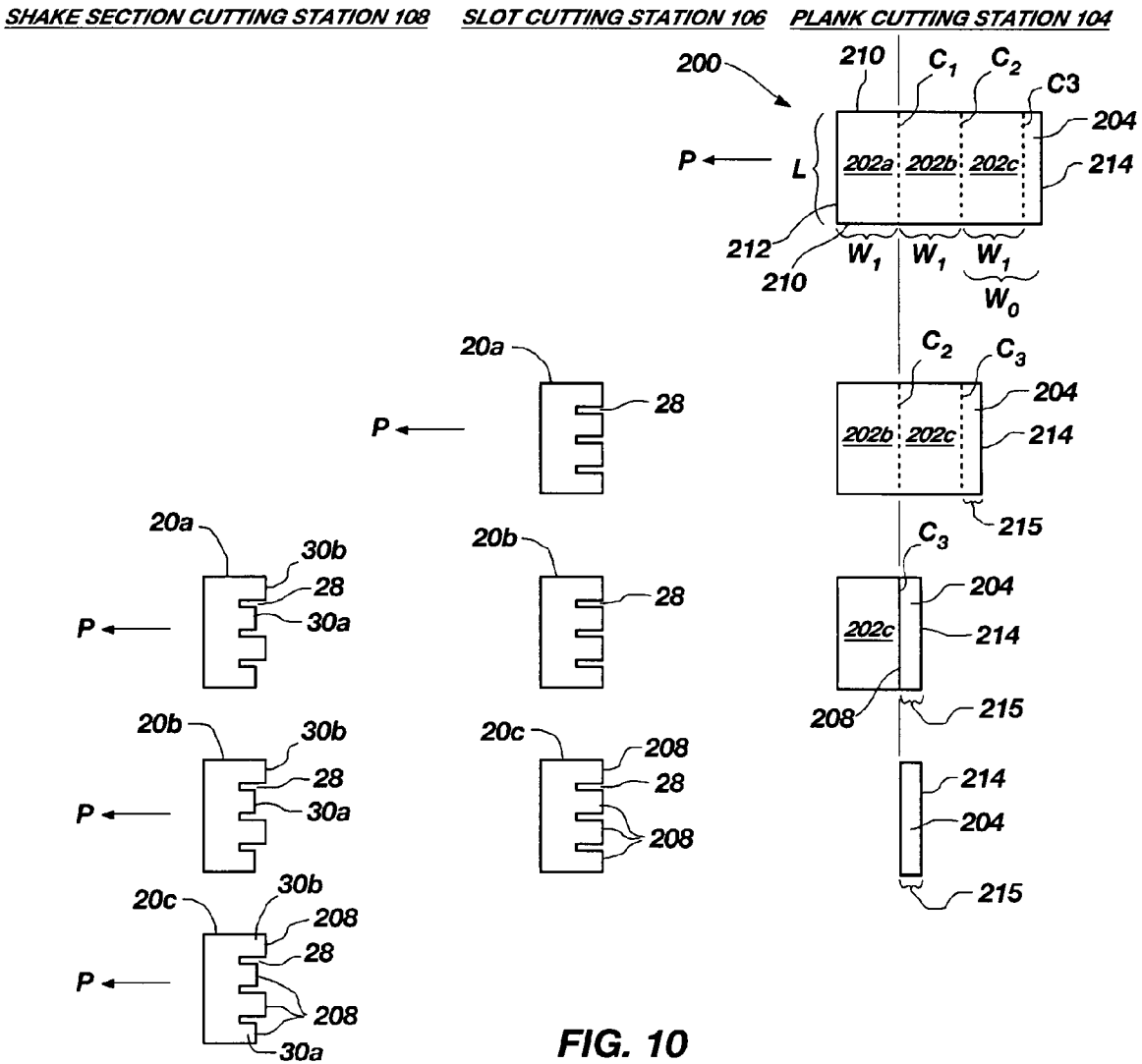
FIG. 10 is a schematic diagram of a method of manufacturing a shake panel according to one embodiment of the invention.

FIG. 10 schematically illustrates a method of manufacturing the shake panel 20 of FIG. 1 according to one embodiment of the invention. The method may also be used to form shake panels having a variety of configurations different than that of the shake panel 20 shown in FIG. 1. Such configurations are disclosed in U.S. Pat. No. 6,526,717 to Waggoner et al., which is herein incorporated by reference. The embodiment of a method shown in FIG. 10 may be implemented using the cutting machine 100 according to a program of instructions from the controller 103 that instructs the cutting machine 100 to perform the method as described more fully below.

A sheet of fiber-cement 200 having side edges 210, and front and rear edges 212 and 214 having widths equal to the length L of the shake panel 20 to be formed, all of which are smooth edges formed by a process such as water jet cutting, is provided. The sheet 200 of fiber-cement may be in an at least partially cured or cured state. A plurality of planks 202*a*-202*c* having a width $W_1$ and length L may be cut from the sheet 200 along cutting planes $C_1$-$C_3$ shown as dashed lines. Of course, the sheet 200 and the planks 202*a*-202*c* may be sized accordingly so that more than or less than three planks 202*a*-202*c* may be cut from a sheet of fiber-cement 200, depending upon the desired width of the shake panels 20.

With continued reference to FIG. 10, the sheet 200 is moved along the path P by the conveyor assembly to the plank cutting station 104 so that the cutting plane C, is aligned with the lower blade 138 and upper blade 146 thereof. The plank 202*a* is cut from the sheet 200 along the cutting plane $C_1$. Thereafter, the plank 202*a* is advanced to the slot cutting station 106. As the plank 202*a* is advanced to the slot cutting station 106, the sheet 200 is advanced to a position in which the cutting plane $C_2$ is aligned with the lower blade 138 and upper blade 146 of the plank cutting station 104. Accordingly, as the plank 202*b* is being cut from the sheet 200 at the plank cutting station 104, slots 28 are cut in the plank 202*a* at the slot cutting station 106 to form a shake panel 20*a*.

As the shake panel 20*a* is advanced to the shake section cutting station 108, the plank 202*b* is advanced to the slot cutting station 106 and the sheet 200 having a width $W_O$ is advanced to align the cutting plane $C_3$ with the lower blade 138 and upper blade 146 of the plank cutting station 104. The plank 202*c* is cut from the sheet 200 along the cutting plane $C_3$ to a width $W_1$, thus, severing a strip 204 from the rear of the sheet 200. Width 215 of the strip 204 may be approximately 0.25 inches to approximately 0.5 inches. The strip 204 may slide downwardly along the slanted surfaces 147 and 149 of the lower blade assembly 131 (See FIG. 7) to the ground or a waste disposal conveyor. Accordingly, the plank 202*c* has a rough, cut bottom edge 208, giving the appearance that the plank 202*c* is formed of wood and cut with a saw. As the plank 202*c* is being cut, shake sections 30*a* are also cut to length $L_{S1}$, at the shake cutting station 108 in the shake panel 20*a* and the slots 28 are cut in the plank 202*b* to form a shake panel 20*b*.

Thereafter, the shake panel 20*b* is advanced to the shake section cutting station 108 to cut the shake sections 30*a* and the plank 202*c* is advanced to the slot cutting station 106 to have the slots 28 cut therein to form a shake panel 20*c*. Next, the shake panel 20*c* is advanced to the shake section cutting station 108 where the shake sections 30*a* are trimmed to length. In the embodiments in which shake panels 20*a*-20*c* have shake sections of equal length, the act of cutting the shake sections 30*a* at the shake section cutting station 108 may be eliminated.

Figure 11:
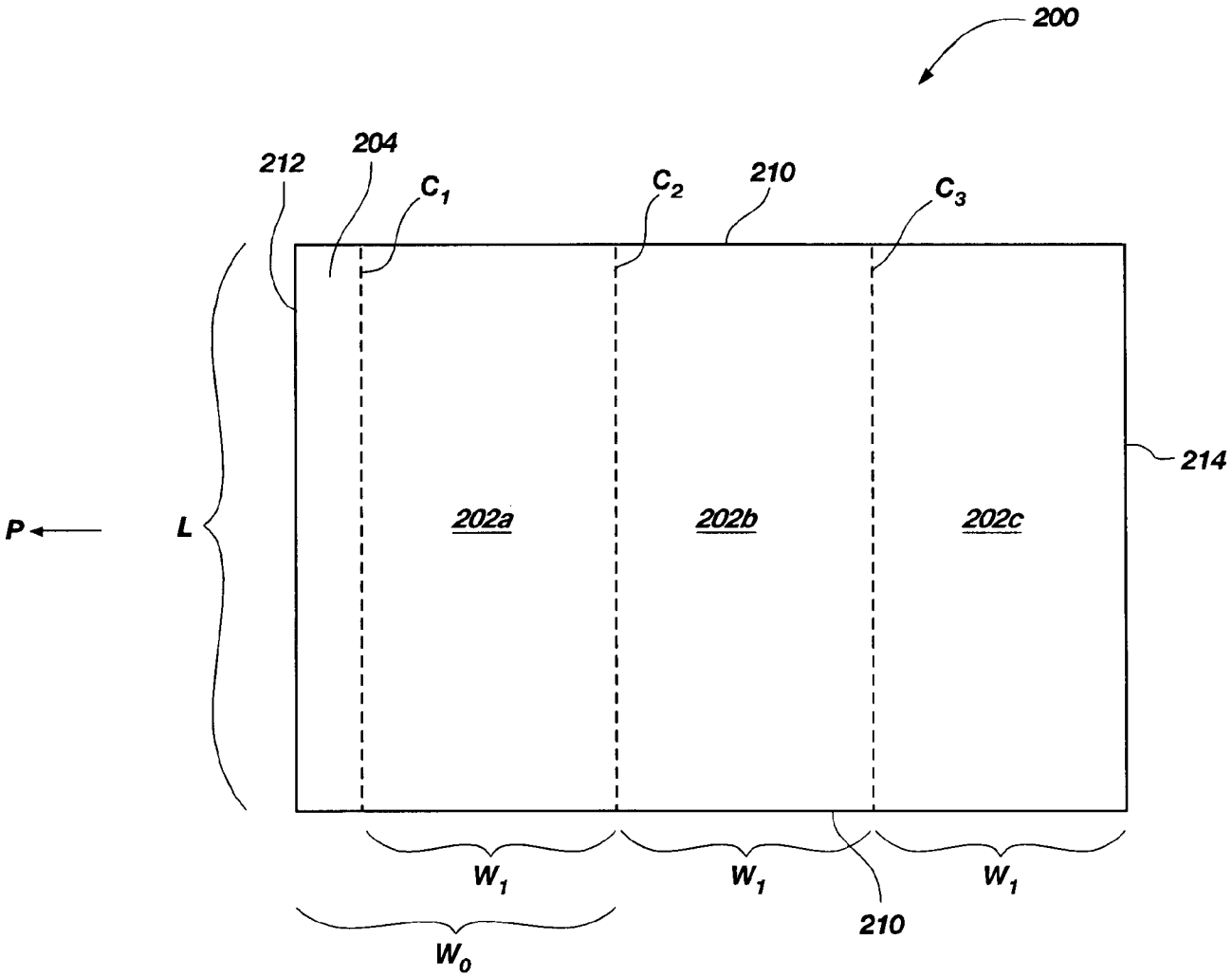
FIG. 11 is a schematic diagram of a method of manufacturing a shake panel according to another embodiment of the invention.

FIG. 11 is a schematic cutting diagram illustrating another embodiment of a method of manufacturing the shake panel 20. In this method, instead of the strip 204 being severed from the last plank 202*c*, the strip 204 is severed from the first plank 202*a*. In such an embodiment, the slot cutting station 106 is configured to cut slots in the planks 202*a*-202*c* that extend widthwise inwardly from the downstream, longitudinal edge of the planks 202*a*-202*c* in a direction generally opposite to the path P. Accordingly, the plank 202*a* has a width $W_0$ and the strip 204 may be severed from the first plank 202*a*.

After severing the strip 204 along the cutting plane $C_1$, at the plank cutting station 104, the sheet 200 is advanced and cut along the cutting plane $C_2$ at the plank cutting station 104 to form the plank 202*a*. The plank 202*a* is advanced to the slot cutting station 106 and slots 28 are cut therein to form the shake panel 20*a* while the sheet 200 is advanced and cut along the cutting plane $C_3$ at the plank cutting station 104 to form the planks 202*b* 202*c*. Then, as the shake panel 20*a* is advanced to the shake section cutting station 108 and the shake sections 30*a* are trimmed to length $L_{S1}$, the plank 202*b* is advanced to the slot cutting station 106 and the slots 28 are cut therein to form shake panel 20*b*. Thereafter, the shake panel 20*b* is advanced to the shake section cutting station 108 and the shake sections 30*a* are trimmed to length $L_{S1}$, and the plank 202*c* is advanced to the slot cutting station 106 and the slots 28 are cut therein to form the shake panel 20*c*. Finally, the shake panel 20*c* is advanced to the shake section cutting station 108 and the shake sections 30*a* are trimmed to length.

In the embodiment of FIG. 11, the strip 204 severed from the first plank 202*a* includes the downstream, front edge 212. In order to allow the strip 204 to fall downwardly and out of the way of the advancing planks 202*b* and 202*c*, the lower blade assembly 131 of the plank cutting station 104 is modified from the embodiment shown in FIG. 7. The positions of the blade holder portions 134 and 136 are reversed. The blade holder portion 136 is positioned on the downstream side of the lower blade 138. The slanted surface 147 of the blade holder portion 136 and the slanted surface 149 of the intermediate plate 132 slant downwardly away from the lower blade 138. This allows the strip 204 severed from the first plank 202*a* on the downstream side of the lower blade 138 to fall downwardly to the ground or to a waste disposal conveyor situated below the lower blade assembly 131.

Accordingly, the embodiments of the methods described above with respect to FIGS. 10 and 11 enable continuously advancing the sheet 200 and the planks 202*a*-202*c* cut therefrom along the path P. Additionally, the methods provide a cut bottom edge 208 on the last plank 202*c* or the upstream longitudinal edge of the first plank 202*a* cut from the sheet 200 in addition to the other planks. This provides the bottom edges 208 of the shake sections 30*a* and 30*b* of all the shake panels 20*a*-20*c* cut from the planks 202*a*-202*c* the appearance of being formed of wood and cut with a saw. Furthermore, the shake panels 20*a*-20*c* so formed are all oriented in the same direction when they are advanced along the path P after cutting the shake sections 30*a*. Additionally, the cutting machine 100 enables cutting shake panels 20 from the sheet 200 all having the same shake section configuration. The aforementioned embodiments for cutting machine 100 and the methods of FIGS. 10 and 11 also enable cutting shake panels without generating a substantial amount of hazardous dust particles formed from the constituents of the panel.

It should be noted, that the cutting operations to define the slots 28 and the shake sections 30*a* and 30*b* may be reversed. For example, in another embodiment of a method, the shake sections 30*a* may be cut in the planks 202 before the slots 28 are cut and the slots 28 cut thereafter between adjacent shake sections 30*a* and 30*b*. Additionally, as previously discussed, a variety of different shake geometries may be cut at the shake cutting station 108 such as rounded or scalloped shake sections.

Although the invention has been described with reference to the disclosed embodiments, persons skilled in the art will recognize that changes may be made in form and detail without departing from the spirit and scope of the invention. For example, although the cutting machine has been described as suitable for use in cutting fiber-cement materials, it may be used to cut and define shapes in workpieces formed of other materials, such as ceramics and other cement compositions. Such modifications are well within the skill of those ordinarily skilled in the art. Accordingly, the invention is not limited except as by the appended claims.

What is claimed is:

1. A method of producing fiber-cement shake panels from a fiber-cement sheet, comprising:

(a) providing a fiber-cement sheet comprising cement, cellulose and silica;

(b) cutting the fiber-cement sheet along a cutting plane at a station and thereby producing a plank having a downstream edge and an upstream edge, wherein the upstream edge is formed along the cutting plane and the plank has a width from the downstream edge to the upstream edge;

(c) forming a plurality of slots through the plank at the upstream edge of the plank and thereby producing a fiber-cement shake panel having a web portion and a plurality of shake sections extending from the web portion, wherein the slots extend from the upstream edge of the plank to an intermediate portion of the plank;

(d) moving the fiber-cement sheet so that another portion of the fiber-cement sheet is at the station;

(e) repeating processes (b)-(d) and thereby producing a plurality of fiber-cement shake panels from the fiber-cement sheet, wherein the slots of all of the fiber-cement shake panels formed from the fiber-cement sheet extend from the upstream edge to the intermediate portion of each corresponding fiber-cement shake panel; and (f) cutting a strip having a width less than the width of the planks from either an up stream end of the sheet before cutting the plants, or from the downstream edge of the last plank remaining after the other planks have been cut.

2. The method of claim 1, wherein:

cutting the plank comprises shearing the fiber-cement sheet along the cutting plane with a blade; and the upstream edge of all fiber-cement shake panels formed from the fiber-cement sheet are sheared edges.

3. The method of claim 1 wherein the slots are formed by driving a plurality of slot cutting blades through each plank and into corresponding dies below the fiber-cement sheet.

4. The method of claim 1 wherein, after being cut from the fiber-cement sheet, the strip falls downwardly across a slanted face.

5. The method of claim 1, further comprising trimming the shake sections.

6. The method of claim 5 wherein trimming the shake sections comprises shearing end portions of the shake sections at the upstream edge so that at least two of the shake sections have different lengths.

7. The method of claim 5 wherein trimming the shake sections comprises shearing end portions of the shake sections at the upstream edge so that the shake sections have rounded ends.

8. The method of claim 5 wherein the planks are cut from the fiber-cement sheet at a plank cutting station, the slots are formed in the planks at a slot cutting station downstream from the plank cutting station, and the shake sections are trimmed at a shake cutting station downstream from the slot cutting station.

9. The method of claim 8 wherein all planks cut from the fiber-cement sheet move generally parallel to slot cutting blades at the slot cutting station and in one direction from the plank cutting station to the slot cutting station and then to the shake cutting section.

10. The method of claim 1 wherein the planks are cut from the fiber-cement sheet at a plank cutting station and the slots are cut through the planks at a slot cutting station downstream from the plank cutting station.

11. The method of claim 10 wherein the planks are cut from the fiber-cement sheet by driving at least one plank cutting blade into the fiber-cement sheet along the cutting plane, and wherein the slots are formed in each plank by driving a plurality of slot cutting blades through each plank at the upstream edge and passing the slot cutting blades into corresponding dies below the fiber-cement sheet.

12. The method of claim 11 wherein the fiber-cement sheet is at least partially cured.

13. The method of claim 11 wherein the fiber-cement sheet is in a cured state.

14. The method of claim 11 wherein the plank cutting blade is at least substantially perpendicular to a path along which the planks move from the plank cutting station to the slot cutting station, and wherein the slot cutting blades are at least substantially perpendicular to the plank cutting blade.

* * * * *

UNITED STATES PATENT AND TRADEMARK OFFICE

CERTIFICATE OF CORRECTION

PATENT NO. : 7,640,928 B2
APPLICATION NO. : 11/371452
DATED : January 5, 2010
INVENTOR(S) : Ian Gregg et al.

It is certified that error appears in the above-identified patent and that said Letters Patent is hereby corrected as shown below:

In column 2, line 27, delete "($L_{S1}$," and insert -- ($L_{S1}$ --, therefor.

In column 3, line 5, delete "$P_1$to" and insert -- $P_1$ to --, therefor.

In column 3, line 36, delete "($L_{S1}$," and insert -- ($L_{S1}$ --, therefor.

In column 6, line 40, after "lower" delete "roller" and insert -- rollers --, therefor.

In column 6, line 40, after "upper" delete "roller" and insert -- rollers --, therefor.

In column 9, line 21, delete "C," and insert -- $C_1$ --, therefor.

In column 9, line 34, delete "$W_O$" and insert -- $W_0$ --, therefor.

In column 9, line 47, delete "$L_{S1}$," and insert -- $L_{S1}$ --, therefor.

In column 10, line 3, delete "$C_1$," and insert -- $C_1$ --, therefor.

In column 10, line 14, after "form" insert -- the --.

In column 11, line 35, in claim 1, delete "up stream" and insert -- upstream --, therefor.

In column 11, line 36, in claim 1, delete "plants," and insert -- planks, --, therefor.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,928 B2
APPLICATION NO. : 11/371452
DATED : January 5, 2010
INVENTOR(S) : Gregg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 636 days.

Signed and Sealed this

Sixteenth Day of November, 2010

David J. Kappos

David J. Kappos
*Director of the United States Patent and Trademark Office*